US005195250A

United States Patent [19]

Zito

[11] Patent Number: 5,195,250

[45] Date of Patent: Mar. 23, 1993

[54] ELECTRONIC DEVOLATILIZER

[76] Inventor: Richard R. Zito, 330 N. Mathilda Ave. (#606), Sunnyvale, Calif. 94086

[21] Appl. No.: 744,525

[22] Filed: Aug. 13, 1991

[51] Int. Cl.[5] ..... F26B 3/34

[52] U.S. Cl. ..... 34/1 H; 34/12; 34/60; 219/399

[58] Field of Search ..... 34/1 E, 1 H, 12, 60, 34/61; 219/399, 400; 392/402, 391, 322, 324, 338

[56] References Cited

U.S. PATENT DOCUMENTS

| | | | |
|---|---|---|---|
| 2,042,145 | 5/1936 | Darrah | 34/1 E |
| 2,231,457 | 2/1941 | Stephen | 34/1 J |
| 3,765,099 | 10/1973 | Kohlmannsperger | 34/1 H |
| 3,771,233 | 11/1973 | French et al. | 34/1 H |
| 4,050,162 | 9/1977 | Candor | 34/1 H |
| 4,253,244 | 3/1981 | Kranzler | 34/48 |
| 4,551,924 | 11/1985 | Candor | 34/1 J |
| 4,837,943 | 6/1989 | Mizutani | 34/1 |
| 4,898,189 | 2/1990 | Wochnowski | 131/299 |
| 4,934,385 | 6/1990 | Wochnowski | 131/290 |

OTHER PUBLICATIONS

Y. Asakawa, "Promotion and Retardation of Heat Transfer by Electric Fields," Nature, vol. 261, May 20, 1976, pp. 220–221.

Y. Asakawa, Title Unknown, Japan Society of Mechanical Engineers (JSME) Semi-int. Symp., 1 (213), 1967, pp. 95–102.

*Primary Examiner*—Henry A. Bennet

*Assistant Examiner*—Denise L. F. Gromada

[57] ABSTRACT

An electronic device for devolatilizing agricultural and other products. The device utilizes an electrode (100) enclosed in a helium filled insulating sheath (110) suspended above a vessel (150) containing the product to be devolatilized. A high voltage power supply (140) is connected to electrode (100) by a high voltage cable (130). High voltage power supply (140) is switched on while a fan (70) blows air over the product.

1 Claim, 2 Drawing Sheets

ELECTRONIC DEVOLATILIZER

BACKGROUND-FIELD OF INVENTION

This invention relates to non-thermal, electronic, removal of water, ethanol, and other volatile materials, primarily, but not exclusively, from agricultural products such as vanilla, spices, grain, and various powders.

BACKGROUND-DESCRIPTION OF PRIOR ART

The removal of volatiles such as water and ethanol from agricultural products is a process of prime importance to the food processing industry. Damp food products such as grain may spoil due to the growth of microbes, thereby limiting storage life (*ASHREA Handbook* 1985 *Fundamentals. ASHRAE,* 1985, Atlanta, GA., p. 10.1–10.11; *ASHRAE Handbook* 1982 Applications, ASHRAE, 1982, Atlanta, GA, p. 22.2–22.14; A. B. Meinel, M. P. Meinel, *Applied Solar Energy,* Addison-Wesley, Reading, MA. 1976, p. 562–564). This is particularly a problem in damp areas of the country such as the northwest. Also, powdered food products can be especially difficult to dry because a collection of small particles tends to provide an enormous surface area which can be wet by adsorbed water molecules. Consequently, most powders are rather hygroscopic. Paprika is a good example of such a hygroscopic powdered agricultural product. The presence of moisture tends to encourage the growth of microbes in such powders and promotes the eventual spoilage of the product. Clearly, at least partial desiccation of many kinds of agricultural products is desirable. Typically, drying is accomplished by the application of heat to the product (G. A. Kranzler, 1981, U.S. Pat. No. 4,253,244; W. Wochnowski, 1990, U.S. Pat. No. 4,898,189; W. Wochnowski, 1990, U.S. Pat. No. 4,934,385). However, thermal drying has many drawbacks. First of all thermal methods can require considerable energy when large amounts of material are involved. Furthermore, application of heat to many foods can change their flavor. This is particularly true of powdered spices like paprika. Since spices are purchased primarily for their flavor, even small flavor changes are considered highly undesirable. Finally, thermal desiccation can be slow, thereby limiting the production of the final product.

Devolatilization, however, is not limited to removal of water. Frequently, the removal of other materials, like ethanol, is required. It is a common practice, for example, to extract vanilla from harvested vanilla beans (actually vanilla orchid seed pods) by soaking them in ethanol (R. Rosengarten Jr. *The Book of Spices,* Pyramid Books, New York, 1973, p. 434). The resulting vanilla extract is at first quite weak and must be concentrated by driving off some of the ethanol. The application of heat to the extract is very undesirable since heat would easily destroy the delicate flavor of natural vanilla. Therefore, concentration is achieved by a slow, room temperature, evaporation process which severely limits the output of product and requires a processing plant of considerable floor space so as to expose as much extract surface area to air as possible. Furthermore, from an industrial safety point of view, there is the even present danger of explosion due to the presence of ethanol vapors.

In this patent an electronic devolatilizer is described which can accelerate removal of volatiles from agricultural materials without application of heat. The method was first employed in Japan for the accelerated drying of delicate, heat intolerant, fabrics during cleaning (Y. Asakawa, 1967, data presented at *Jap. Soc. Mech. Eng. Semi-int. Symposium* 1 (213), 95–102, 1967; Y. Asakawa, *Nature,* vol. 261, no. 5557, pp. 220–221, May 20, 1976; I. Mizutani, 1989, U.S. Pat. No. 4,837,943). It was discovered that damp cloth could be dryed in half the usual time required by placing a high voltage electrode over the wet material. No theory was given to explain the effect. However, its seems likely that polar water molecules will have a tendency to migrate toward the high voltage electrode, in the electric field gradient which is products (J. D. Jackson, *Classical Electrodynamics,* John Wiley, New York, 1975, p. 142–3), and away from the wet surface, thereby encouraging dry. While this theory seems plausible, it is still somewhat uncertain and I do not wish to be bound by it.

Finally, it should be noted that although this patent application is primarily intended for the devolatilization of agricultural products, other materials might benefit from non-thermal devolatilization. For example, it may be necessary to remove water from powdered chemicals or pharmaceutical without applying heat that might cause some chemicals to decompose, oxidize, or explode.

OBJECTS AND ADVANTAGES

Several objects and advantages of the present invention are:

(a) to provide accelerated removal of volatile polar molecules from agricultural products, powders, and other materials without the application of product damaging heat;

(b) to provide removal of flammable volatiles, and removal of volatiles from various flammable products, in a way which reduces the chance of explosion or fire;

(c) to provide increased product output when rapid devolatilization is required durging product processing;

(d) to provide a method of devolatilization which requires very little energy;

(e) to provide a method of devolatilization that protects workers from toxic fumes.

DRAWING FIGURES

REFERENCE NUMERALS IN DRAWINGS

Figure 1:
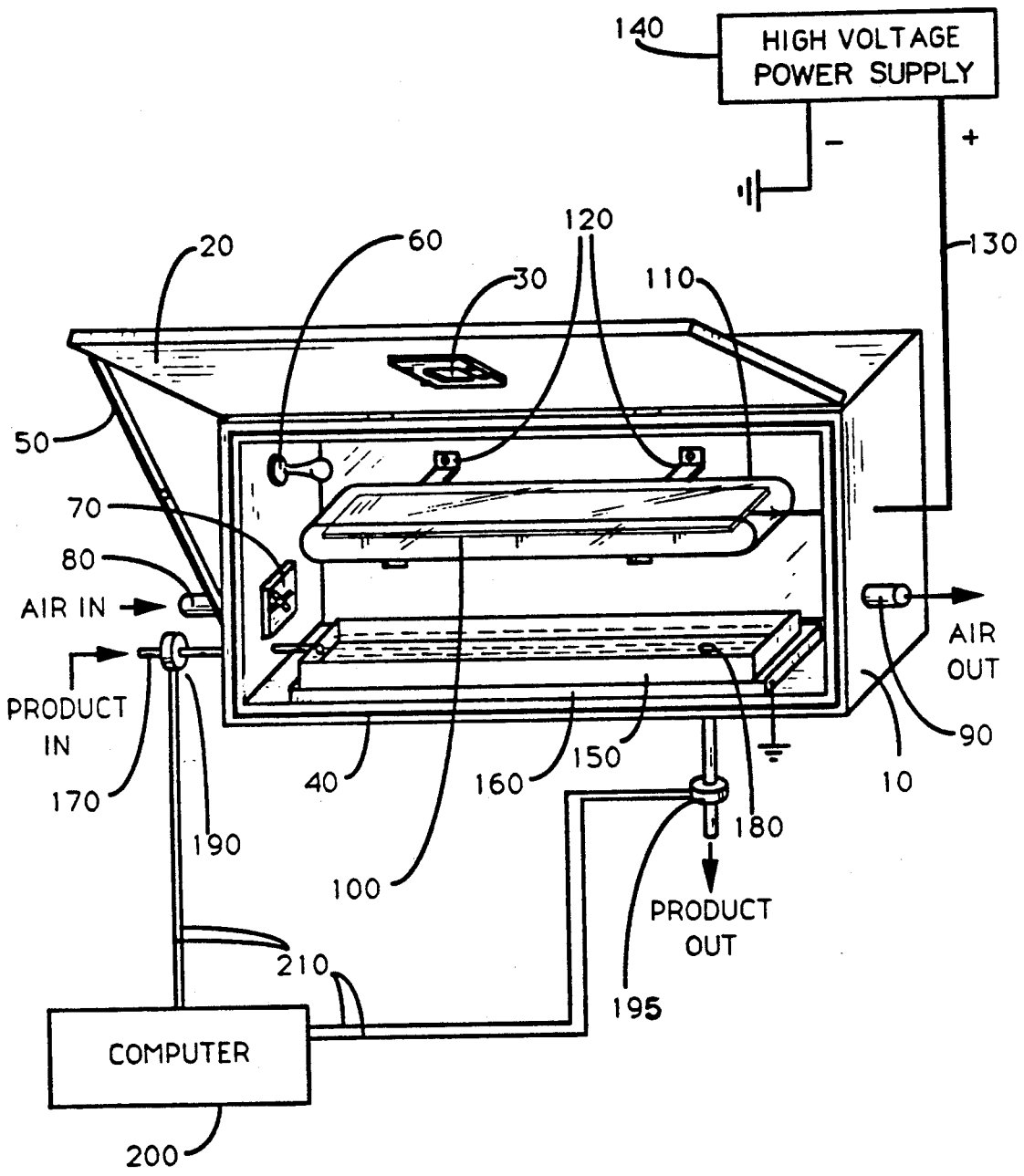
FIG. 1 shows an oblique view of the electronic devolatilizer with its door open to reveal internal parts.

10 vapor-proof enclosure
20 door
30 observation window
40 O-ring vapor seal
50 door support
60 electric lamp
70 electric fan
80 air inlet
90 vapor exhaust
100 electrode
102 conducting needles
104 conducting plate
106 electrical connector
110 insulating sheath
120 supports
130 high voltage cable
140 high voltage power supply
150 vessel 160 conducting slab
170 product inlet
180 product drain
190 electric product inlet valve
195 electric product drain valve
200 computer
210 wires

Figure 2:
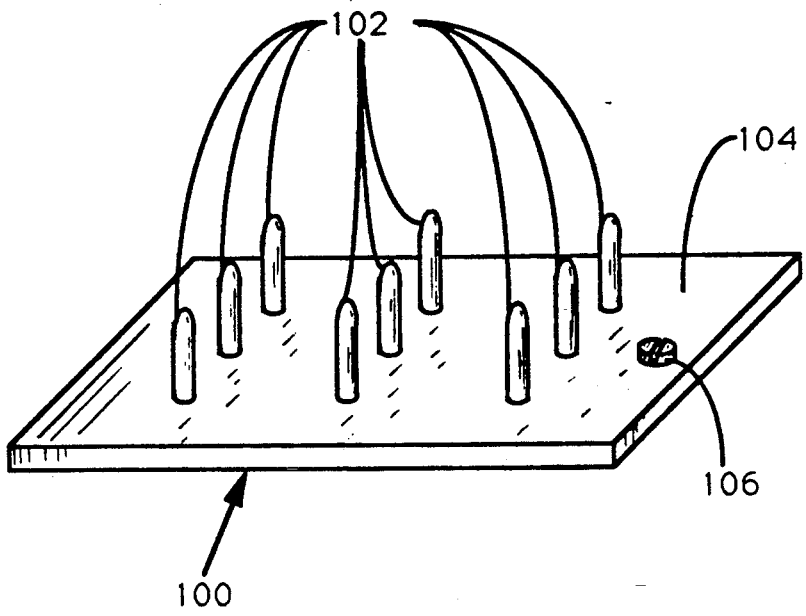
FIG. 2 shows a close-up bottom view of electrode 100.

DESCRIPTION-FIGS. 1 and 2

A vapor-proof enclosure 10, made of an electrically nonconducting material, prevents the escape of possibly explosive, flammable or toxic vapors into the surrounding area where personnel work. Vapor-proof enclosure 10 has a door 20 with an observation window 30 preferably, but not necessarily, made of clear plastic or shatter-proof glass through which the devolatilization process can be visually observed. Window 30 can be sealed against door 20 with silicone rubber or some other adhesive. Door 20 is sealed against vapor-proof enclosure 10 by an O-ring vapor seal 40. A door support 50 can be used to hold door 20 open when the apparatus is being repaired or adjusted. An electric lamp 60 provides illumination on the interior of vapor-proof enclosure 10 when necessary during observation or repair. It is also helpful, but not necessary, to paint the interior of vapor-proof enclosure 10 white or some other reflective color to facilitate such inspection. An electric fan 70 pulls fresh air in through an air inlet 80 into vapor-proof enclosure 10. This air flow carries away volatiles fumes which may then exit via a vapor exhaust 90. An electrode 100 is used to draw volatile polar molecules away from a material to be devolatilized.

Electrode 100 is made of conducting needles 102 press fitted into a conducting plate 104 having an electrical connector 106. The radio of the length to the width of conducting needles 102 is typically ten to one, although other ratios are possible and will work well. Electrode 100 can be made of copper parts, but parts of stainless steel or carbon also seem to work well and resist corrosion. An insulating sheath 110, surrounds electrode 100 and is preferably, but not necessarily, made of plastic or shatter resistant glass and is thick enough to prevent dielectric breakdown and the formation of sparks at the high voltages used. Insulating sheath 110 is also preferably, but not necessarily, back-filled with a gas having a high ionization potential, like helium, so that spark and corona formation is suppressed. Electrode 100 and insulating sheath 110 are held in place by supports 120 which are made of a nonconducting material. Good results have been obtained when supports 120 are adjusted so that the sharp tips of conducting needles 102 are a few millimeters from the surface of the product, although other separations are possible. A high voltage is applied to electrode 100 by a high voltage cable 130 which passes through insulating sheath 110 and is attached to electrical connector 106. If insulating sheath 110 is made of plastic, then high voltage cable 130 can be sealed to insulating sheath 110 with a little silicone rubber or some other insulating sealant. If, on the other hand, insulating sheath 110 is made of glass then high voltage cable 130 can be sealed to insulating sheath 110 by a glass to metal seal, whose fabrication is well documented in the literature (J. H. Moore, C. C. Davis, A. A. Caplan, *Building Scientific Apparatus; A Practical Guide for Design and Construction,* Addison-Wesley, London, 1983, pp. 66–68), and then insulated with a little silicone rubber or another insulating sealant. Other methods of passing high voltage cable 130 into insulating sheath 110 are also possible. The other end of high voltage cable 130 is connected to the positive terminal of a high voltage power supply 140. The negative terminal of high voltage power supply 140 is grounded.

A vessel 150, filled with a product to be devolatilized, is made of an electrically nonconducting material and rests on a conducting slab 160 which shares a common ground with the negative terminal of power supply 140. The product to be devolatilized, typically, a liquid, enters through a product inlet 170. The final devolatilized product may be removed through a product drain 180. An electric product inlet valve 190 controls the flow of initial raw materials through product inlet 170 while an electric product drain valve 195 control the flow of final devolatilized product out of product drain 180. Both electric product inlet valve 190 and electric product drain valve 195 are controlled by a computer 200 through wires 210.

OPERATION-FIGS. 1 AND 2

First, carefully inspect O-ring vapor seal 40 to be sure it is clean and free of debris that might prevent a tight seal. Next, close door 20 of vapor-proof enclosure 10 by releasing door support 50. With electric product drain valve 195 closed, electric product inlet valve 190 is opened. Product rich in volatiles then flows through product inlet 170 into vessel 150 until computer 200 sends a signal through wires 210 to shut off the flow. Next electric fan 70 is turned on to pull fresh air through air inlet 80. Vapors leaving the system through vapor exhaust 90 should be expelled to outside air. After checking all ground connections to high voltage power supply 140 and conducting slab 160, high voltage power supply 140 can be turned on.

Typically, a DC voltage of about +21,000 volts is applied to electrode 100 through high voltage cable 130 connected to conducting plate 104 by means of electrical connector 106. An extremely strong electric field will now appear at the sharp tips of conducting needles 102 which are in electrical contact with conducting plate 104. Since there is no significant current flow of any kind between high voltage power supply 140 and grounded conducting slab 160, the power requirements for the electronic devolatilizer are negligible. Only a small power drain on the order of one watt can be detected due to ionization and a little current leakage. Devolatilization times are on the order of 20 minutes. However, this time interval varies depending on the amount of devolatilization required, the magnitude of the applied high voltage, the depth of the product in vessel 150 and the height of electrode 100 above vessel 150. This height can be adjusted by raising or lowering the position of supports 120 attached to the rear wall of enclosure 10. After devolatilization, electric product drain valve 195 is opened to remove the final product through product drain 180.

The apparatus can now be refilled by shutting electric product drain valve 195 and opening electric product inlet valve 190 as previously described. The draining and filling operation can be visually monitored through observation window 30 using electric lamp 60 for illumination. High voltage power supply 140 need not be shut off during refilling. All electric valve opening and closing operations can be controlled by computer 200 via signals sent through wires 210. Computer 200 should have an internal clock to determine the time when each valve should be open or closed. Computer 200 may also contain a digital to analogue converter board to generate appropriate signals for the electric product inlet valve 190 and the electric product drain valve 195.

SUMMARY, RAMIFICATION AND SCOPE

Accordingly, the reader will see that the invention described here provides a non-thermal method of devolatilization that reduces the probability of explosion and toxic or flammable fume release. Although the description above contains many specificities, these should not be construed as limiting the scope of the invention but as merely providing illustrations of some of the presently preferred embodiments of this invention.

For example, the vapor-proof enclosure 10 may be any color, and in the case of non-toxic, non-explosive, and non-flammable volatiles, like water, enclosure 10 may even be dispensed with. Vapor-proof enclosure 10 may also be supported on legs of any convenient height, or suspended from an overhead structure. Units of the invention described in this application can also be stacked one on top of the other, side by side, or both.

High voltage power supply 140 need not be of the DC type supplying +21,000 volts to electrode 100. Satisfactory devolatilization can also be achieved when other DC or AC voltages are applied to electrode 100. Naturally, if high voltage power supply 140 is, for example, of the 50 Hz AC type then high voltage cable 130 will supply alternating positive and negative voltages to electrode 100 while the other terminal of high voltage power supply 140 is grounded. AC frequencies other than 50 Hz can also be useful for devolatilization.

Other designs are also possible for electrode 100 and its parts. The number of conducting needles 102 on conducting plate 104 can be varied from one to a densely packed array. Also, the placement pattern of conducting needles 102 on conducting plate 104 can vary. Holes can also be drilled in conducting plate 104, and these holes can have various shapes and sizes. Conducting plate 104 can itself have an entirely different shape, such as a circular perimeter instead of a rectangular one. Other shapes are also possible. The length, width and tip design of individual conducting needles 102 can also vary, and each conducting needle 102 can be individually attached to its own high voltage cable supplying its own particular voltage. Any conducting material or combination of materials can be used to construct electrode 100.

Also, the shape of insulating sheath 120 may vary. For example, if conducting plate 104 has a circular perimeter instead of a rectangular one, then insulating sheath 120 would have the shape of a circular pillbox instead of a parallelepiped. The composition of insulating sheath 120 may also vary. Plastics, glasses, ceramics, or other materials might be used. In many cases insulating sheath 120 may not be necessary, especially if a corona is required near the product to dissociate voltage molecules. In that case, there may be an advantage to having holes in conducting plate 104 between conducting needles 102. This configuration would allow fumes to pass through the holes in electrode 100. Electric fan 70 could then be placed above electrode 100 to blow away fumes of volatile materials. This latter configuration has the advantage of increasing the rate of devolatilization by allowing electrode 100 to be placed extremely close to the product, since air flow between the product and electrode is no longer required.

Supports 120 may be placed below, above, or around electrode 100, or the combination of electrode 100 and insulating sheath 110. Furthermore, the number of supports may vary from 1 to as many as is necessary to adequately support electrode 100 at any desired height above vessel 150. Another variation is to use a system of supports to hold multiple layers of electrode 100 (or electrode 100 and insulating sheath 110) and vessel 150 within a single vapor-proof enclosure 10.

Also, the conducting slab 160, which can have any convenient thickness, can be removed. In that case, vessel 150 should be made of out of a conductor and grounded. Vessel 150 can also contain a stirrer to bring fresh material in vessel 150 to the surface for devolatilization. An overflow prevention drain hole can also be placed near the top of vessel 150. Or, vessel 150 of the current invention can be replaced with a slowly moving belt carrying powder under electrode 100. Also, in some situations it may be permissible to add a small amount of heat to the product during devolatilization, providing the temperature of the product does not exceed some predetermined value. In that case a heating lamp, heating coil, heating filament, or heater of some type may be placed in vapor-proof enclosure 10. In the case of explosive volatiles, power to the heat, electric lamp 60, electric fan 70, and high voltage power supply 140 (which may be the DC or AC type) can be controlled by spark-proof switches.

Thus, the scope of my invention should be determined by the appended claims and their equivalents, rather than by the examples given.

I claim:

1. An electronic devolatilizer comprising:

a. an electrode wherein said electrode is made of a conducting plate upon which are mounted a plurality of conducting needles with sharp tips, whereby every high electric fields near said tips can be achieved, b. an insulating sheath around said electrode, whereby sparks may be prevented from forming between said electrode and ground potential.

c. a spark suppressing gas within said sheath, whereby higher voltages may be applied to said electrode, d. a vessel under said electrode for holding material to be devolatilized, e. a high voltage power supply electrically connected to said electrode.

* * * * *